US005223152A

United States Patent [19]

Freymeyer et al.

[11] Patent Number: 5,223,152

[45] Date of Patent: Jun. 29, 1993

[54] RECOVERED OIL DEWATERING PROCESS AND APPARATUS WITH WATER VAPORIZING IN BLOWDOWN DRUM

[75] Inventors: Douglas A. Freymeyer, Everson; J. Paul Love, Custer; Richard L. Holloway; Daniel L. Torres, both of Bellingham, all of Wash.; Alfred G. Brosman, Homestead, Fla.

[73] Assignee: Atlantic Richfield Company, Los Angeles, Calif.

[21] Appl. No.: 774,045

[22] Filed: Oct. 8, 1991

[51] Int. Cl.[5] ..... C10G 33/00

[52] U.S. Cl. ..... 210/774; 196/105; 196/135; 208/131; 208/184; 208/187; 210/137; 210/180; 210/182; 210/195.1; 210/805; 210/806; 210/808

[58] Field of Search ..... 196/105, 46, 104, 135; 208/131, 184, 187, 308, 340; 210/175, 194, 182, 774, 805, 806, 137, 180, 195.1, 197, 259, 770, 188; 55/55, 189

[56] References Cited

U.S. PATENT DOCUMENTS

| | | | |
|---|---|---|---|
| 2,550,432 | 4/1951 | Thompson | 210/774 |
| 2,752,290 | 6/1956 | Beattie | 208/131 |
| 3,248,321 | 4/1966 | Fagan | 208/187 |
| 3,705,077 | 12/1972 | Franz et al. | 162/30 |
| 3,855,069 | 12/1974 | Hess et al. | 201/2.5 |
| 3,876,538 | 4/1975 | Hess et al. | 210/21 |
| 3,917,564 | 11/1975 | Meyers | 208/131 |
| 4,014,661 | 3/1977 | Mess et al. | 44/51 |
| 4,118,281 | 10/1978 | Yan | 201/2.5 |
| 4,334,981 | 6/1982 | Holloway et al. | 208/131 |
| 4,547,284 | 10/1985 | Sze et al. | 208/50 |
| 4,666,585 | 5/1987 | Figgins et al. | 208/131 |
| 4,874,505 | 10/1989 | Bartilucci et al. | 208/131 |
| 4,968,407 | 11/1990 | McGrath et al. | 208/131 |
| 4,994,169 | 2/1991 | Godino et al. | 196/104 |

OTHER PUBLICATIONS

Laurence R. Poche et al. *Oil & Gas Journal*, Jan. 7, 1991 "Solvent Extraction of Refinery Waste Rates EPA BDAT".

Publication—"Delayed Coking", John E. Kasch and E. W. Thiele, pp. 89-90, Jan. 1956, The Oil and Gas Journal.

Article in "Hydrocarbon Processing", p. 87, Author Unknown, Jul. 1971.

*Primary Examiner*—Joseph W. Drodge

*Attorney, Agent, or Firm*—Christie, Parker & Hale

[57] ABSTRACT

A process and apparatus for dewatering a recovered oil stream prior to the recovered oil stream being fed to a fractionator for reprocessing into product s rea s uses a blowdown drum controlled like a drstillatron tower so that the bottoms temperature of the blowdown drum is maintained at a temperature above the dewpoint temperature of the water in the blowdown drum by a reboiler. For refineries that contain a delayed coker unit and a coker fractionator which is used for fractionating light products from residual oil serving as coker feedstock, which coker fractionator is also used to fractionate recovered oil containing water and hydrocarbons, a coker blowdown drum is controlled to maintain an appropriate bottoms temperature to achieve separation in the blowdown drum of water from the hydrocarbons in the recovered oil stream, and the blowdown drum is thus used for dewatering the recovered oil before it is fed to the coker fractionator.

18 Claims, 1 Drawing Sheet

RECOVERED OIL DEWATERING PROCESS AND APPARATUS WITH WATER VAPORIZING IN BLOWDOWN DRUM

FIELD OF THE INVENTION

This invention is directed to dewatering a refinery recovered oil stream prior to reprocessing of that stream.

BACKGROUND OF THE INVENTION

Waste streams containing oil, water, high molecular weight fractions, green waxes, coke fines and other solids are produced during the refining of petroleum. These waste streams are generated as a result of the refinery process itself, cleaning processes, maintenance and other such occurrences. It is highly desireable to recover, to the extent possible, the valuable products contained in these waste streams, not only for realizing the value of the products recovered but for minimizing the amount of waste, which must be extensively treated to allow for disposal in an environmentally acceptable manner.

Normally, refinery waste streams are collected and sent to an API separator for initial processing. At the API separator, gravity separates the refinery waste into three layers, a primarily-solids or sludge layer at the bottom, a primarily-water layer in the middle and a primarily-oil layer at the top. The primarily oil layer is skimmed from the top of the API separator and collected in a large surge tank for eventual reprocessing to recover valuable products. The recovered oil or slop oil from this primarily-oil layer is typically composed of 80 to 90 weight percent oil with the remainder being water. Some entrained solids, such as green waxes and coke fines, may be present in the recovered oil but would usually be at very low levels.

Recovered oil normally contains a wide boiling range of hydrocarbon materials. Thus, reprocessing of recovered oil is typically carried out by feeding the recovered oil to a fractionator or distillation column to separate out the various products. Although other fractionators have and may be used for this reprocessing, for refineries that contain a delayed coker unit it is usually the coker fractionator that is used to fractionate the recovered oil. Conventionally, a recovered oil stream is pumped from tankage through a preheater and then fed to the bottom of the coker fractionator. However, conventional reprocessing of recovered oil has presente many operational problems.

Refinery recovered oil contains a significant amount of water. Water is immiscible in oil but is not easily separated completely from the oil in the API separator because it becomes dispersed in the oil. The dispersed water is stabilized in the oil by the high molecular weight fractions, green waxes, coke fines and other finely divided solids that are typically found entrained in recovered oil. The emulsion is not readily susceptible to emulsion breaking techniques. Although some refiners have tried using emulsion breakers in an attempt to break up the emulsion and settle out the water in a storage tank, this approach is expensive and has shown only marginal, if any, success.

When recovered oil containing a significant amount of water, such as 5 weight percent or greater, is heated through indirect heat exchange with a warmer product stream or process steam and fed to a fractionator, the water vaporizes. As the water vaporizes it expands with a significant increase in volume. The force associated with this expansion causes pressure surges which can severely damage equipment and severely upset operation of the fractionator. Such upsets can lead to contamination of the lighter product streams from the fractionator. Pressure swings in the fractionator and the reduction hydrocarbon partial pressure or stripping action caused by the water vaporization can result in heavy boiling range components being carried up he tower thereby contaminating these product streams. These contaminations then cascade into downstream process units resulting in further contaminations.

In addition, the recovered oil storage tanks must be periodically cleaned to remove the finely divided solids that have settled to the bottom of the storage tanks. The solids so removed might otherwise promote the formation of emulsion layers and are a waste that must be disposed of either by incineration, land farming or delivery to an outside waste treater. Each of these disposal methods is expensive and subject to increasingly stringent environmental controls. Yet, periodic removal is necessary with conventional recovered oil reprocessrng to keep emulsion formation and the resultant equipment damage, operational upset and product contamrnatron under control.

A process and apparatus are needed for dewatering recovered oil prior to reprocessing so that equipment damage, operational upset and product contamination are avoided. The process and apparatus should not require the use of extensive additional equipmen or complex treatment of the recovered oil so as to solve the problems associated with conventional reprocessrng with minimal capital expenditure and mlnlmal increase ln maintenance requirements. U.S. Pat. No. 4,968,407 to McGrath and Godino describes a process and apparatus for dewatering and disposing of sludge. However, the process and apparatus of U.S. Pat. No. 4,968,407 are directed to handling sludge, which typically comes from the bottom of an API separator, is composed primarily of solids and has qualities and characteristlcs much different from those of recovered oil. For example, the McGrath and Godino process feeds sludge to the top of a blowdown drum. If recovered oil containing water were fed to the top of a blowdown drum, poor water separation would be achieved and an excessive amount of oil would be carried overhead into the condensation system. Accordingly, U.S. Pat. No. 4,968,407 does not address the problems associated with dewatering recovered oil prior to reprocessing it through a fractionator.

SUMMARY OF THE INvENTION

The present invention provides a process and apparatus for dewatering and recovering valuable products from a refinery recovered o.lr stream containing water. The process comprises the steps of introducing the recovered oil stream into a blowdown drum, maintaining the bottom temperature of the blowdown drum at a temperature above the dewpoint temperature of the water in the drum and feeding a bottom stream from the blowdown drum to a fractionator for separation into product streams. The apparatus comprises a blowdown drum, means for conducting the recovered oil stream into the blowdown drum, means for maintaining the bottom temperature of the blowdown drum at a temperature above the dewpoint temperature of the water in the drum, a fractionator and means for conducting a bottom stream from the blowdown drum, to the fractionator for separation into product streams. Thus, the present invention confines most water expansion at vaporization, to a blowdown drum, which contains fewer and/or more rugged internals, there avo opera upset of and damage to the fractionator.

In preferred embodiment of the present invention, the recovered oil stream is heated to a temperature above the dewpoint temperature of the water in the stream and then flashed across a control valve to vaporize the water in the recovered oil stream before it is introduced into the blowdown drum. Accordingly, most of the water expansion takes place in the transfer piping thereby minimizing any damage to equipment, including the blowdown drum internals and the heater used to heat the recovered oil stream.

In yet another preferred embodiment of the present invention, where the refinery contains a delayed coker unit, the blowdown drum used is a coker blowdown drum and the fractionator used is a coker fractionator. Dewatering and reprocessing the recovered oil stream in the context of the existing delayed coker unit allows the present invention to be implemented with minimal capital expenditure. The coker blowdown drum need only be modified so that it can malntaln an approprlate bottoms temperature to achieve separation of water from the hydrocarbons in a recovered oil stream.

DESCRIPTION OF THE PREFERRED EMBODIMENT

Figure 1:
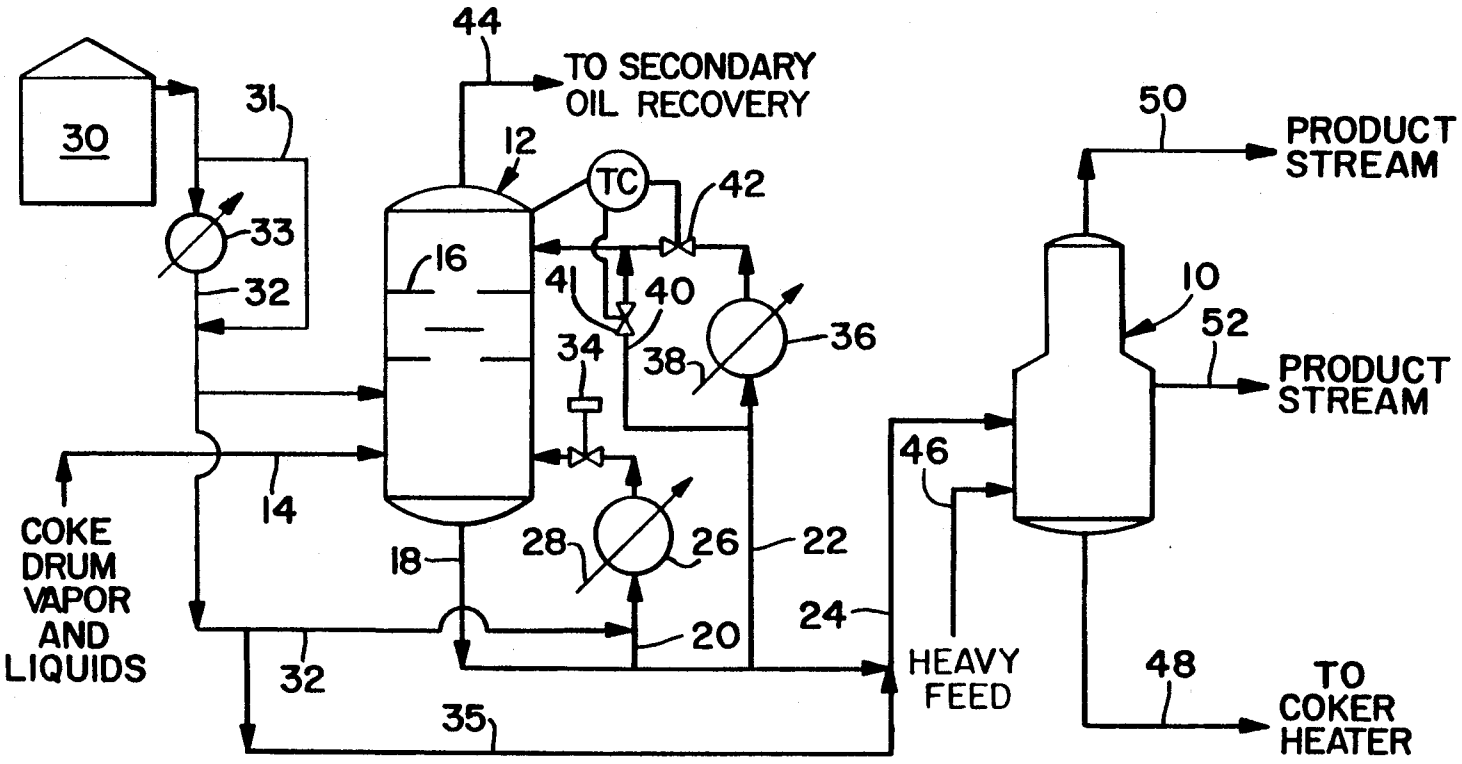
FIG. 1 is a schematic flow diagram illustrating the process and apparatus of the invention.

In the preferred embodiment of the present invention, a coker fractionator 10 that is part of a delayed coker unit is used to fractionate a recovered oil stream to separate out the various products and modified coker blowdown drum 12 is used to dewater the recovered oil stream before it is fed to the coker fractionator. However, it should be understood that the present invention is not limited to use of a coker fractionator and a coker blowdown drum but may be practiced with any fractionator, including a separate fractionator devoted to handling recovered oil, and blowdown drum, or vessel similar to a blowdown drum, capable of serving the aims of the invention. The preferred embodiment is described in the context of a delayed coker unit because delayed coking is a well known refining process that is one of the most commonly-used and most economical at the present time. In addition, it is common to use the coker fractionator in a refingery for reprocessing recovered oil despite the problems encountered with conventional reprocessing techniques.

Delayed coking has been practiced for many years. The process broadly involves thermal cracking of heavy liquid hydrocarbons to produce gas, liquid streams of various boiling ranges and coke.

In the delayed coking process, a petroleum fraction is heated to coking temperature and then fed into the bottom of a first co e drum under conditions which initiate thermal cracking. Lighter constituents are cracked from this petroleum fraction. Then, a porous coke mass is deposited in the first drum through polymerization of the aromatic structures in the petroleum fraction fed to the drum.

In the usual application of the delayed coking process, a feedstock, which may be residual oil, as heated and then fed into a fractionating tower where any light products which might remain in the residual oil are distilled out. When the residual oil comes off a vacuum tower, which is at a high temperature, no preheating is necessary and the residual oil is fed directly to the fractionating tower. If necessary, the residual oil is heated by exchanging heat with the liquid products from the process.

The fractionator bottom stream is then pumped through a furnace where it is heated to the required coking temperature and discharged into the bottom of the first coke drum. The coker feedstock undergoes thermal cracking and polymerization for an extended period resulting in the production of hydrocarbon vapors that leave the top of the drum and porous carbonaceous coke that remains in the drum. The vapors are then returned to the fractionation tower where they are fractionated into the desired cuts. This process is continued until the drum is filled to an appropriate amount of porous coke.

At least a second coke drum parallel to the first is usually waiting to be put on line after the first drum is full of coke so that coke will continue to be made while the first drum has its deposited coke removed. Before the second coke drum is put on line, it is warmed up by diverting some of the hydrocarbon vapors leaving the top of the first drum from the fractionator to the empty second drum. This is referred to as the warm-up stage of the coking cycle. The hydrocarbon vapors diverted to the second drum are cooled, so that some condensation occurs, and undergo a drop in pressure during the preheating of the drum. These vapors may also entrain some of the small amount of water that might remain in the second drum from water used to quench the coke or to aid in coke removal. Thus, the vapor and liquid leaving the second drum during the warm-up stage are sent to a blowdown drum.

Coker feedstock is then switched to the second parallel drum, while steam is introduced to the first drum to strip residual hydrocarbon off the coke. This steaming is referred to as the steam-stripping stage. During steam-stripping, the mixture of steam condensate and hydrocarbon vapors pass to the fractionator for hydrocarbon recovery as during the coking stage. After steam-stripping at about 700°–750°, steam rate, pressure and temperature may be adjusted to begin cooling the coke drum and the effluent from steaming is diverted to the blowdown drum and associated facilities, where it is condensed and dewatered.

After steam input is discontrnued, water is introduced to the bottom of the coke drum to quench the coke bed. During the initial phase of water quenching, the water is vaporized by the hot coke. The resultant steam plus any residual hydrocarbon vapor is passed to the blowdown system for condensation and to separate hydrocarbon during what is referred to as the drum-quench stage. Water addition is continued until the drum is cooled to a temperature at which the top and ot om heads of the drum can be removed for coke removal. The effluent, containing steam, water and hydrocarbons, continues to be sent to settling equipment for removal of entrained oil, etc.

From the above description of a convent:onal delayed coking process it can be seen that during the warm-up, steam-cooling and drum-quench stages, vapor and liquids from the top of the coke drums are fed to a blowdown drum. In conventional practice, this blowdown drum is merely a flash drum for condensing the overhead vapor. The resulting liquids are then sent to secondary oll recovery. Some separation of oil from water will occur in even a conventional coker blowdown drum and an oil stream may be sent to the fractionator. However, in the preferred embodiment of the present invention, the coker blowdown drum is modified so that it is controlled like a distillation tower, and it is then used for heating and dewatering recovered oil before the recovered oil is fed to the coker fractionator for reprocessing, as well as for handling the overhead vapor and liquids from the coke drums. With this form of control, oil/water separation is improved.

With reference to FIG. 1, a modified coker blow.-down drum 12 according to the present invention is shown. This blowdown drum receives vapor and liquids from the top of a coke drum (not shown), during the warm-up, steam-cooling and drum-quench stages of a delayed coking process, through a line 14. Line 14 enters the blowdown drum at the bottom, below internal trays 16. A bottoms stream leaves blowdown drum 12 through a line 18. A portion of this bottom stream is recirculated to the bottom of the blowdown drum through a reboil loop 20. Yet another portion of the bottoms stream from the blowdown drum is recirculated back to the top of the blowdown drum above trays 16 in a reflux loop 22. The remainder of the bottoms stream, which is dewatered oil, is fed to coker fractionator 10 through a line 24.

The blowdown drum bottoms must be kept above the water dewpoint temperature so that water is vaporized and driven out of the oil phase. A reboiler or bottoms circulation heater 26 is provided in reboil loop 20 to heat that portion of the bottoms streams being recirculated back to the bottom of blowdown drum 12 and is controlled to maintain the temperature at the bottom of the blowdown drum above the water dewpoint or boiling point temperature.

Preferably, a bottoms temperature of at least about 350° F. is maintained. The temperature at the bottom of the blowdown drum may be higher than 350° F. but it should not be allowed to fall below about 325° F. This temperature will normally be above the dewpoint of water at the pressures typically found in the bottom of the blowdown drum. This pressure is set by back pressure from the flare header through the system and is usually less than 10 psig. Process steam at about 600 psig is provided to reboiler 26 through a line 28 to achieve the necessary heating of the recirculated bottoms. The reboiler is preferably a steam heat exchanger that allows for indirect heating of the recirculated bottoms by the process steam.

Recovered oil containing water is collected from the top of an API separator (not shown) and other sources in the refinery and sent to a storage tank 30. A stream of recovered oil containing water is then fed from the top of tank 30 to blowdown drum 12 through a line 32. This stream can be pre-heated indirectly in a heat exchanger 33 provided in line 32. Normally waste heat from a product stream will be used to pre-heat the recovered oil stream, but process steam may also be used. If no pre-heating is needed, the stream can bypass heat exchanger 33 in a line 31. This recovered oil stream may be charged directly to the bottom of the blowdown drum below trays 16 or may be introduced into reboil loop 20 upstream of reboiler 26. Both possible routes are shown in FIG. 1. The recovered oil stream could also be charged directly to the coker fractionator through a bypass line 35 should dewatering in accordance with the present invention not be necessary.

If the recovered oil stream is charged directly to the bottom of the blowdown drum, some water flashes out of the stream upon its entering the tower and most of the remainder of the water vaporizes as the water droplets coalesce and drop through the hot liquids in the bottom of the vessel. Some water will exit the bottom of the vessel where the center of a droplet does not reach bubble point temperature before it exits. However, most of the water will be removed. Because the blowdown drum has simplified internals, it is much more suited for hydrocarbon/water separation, and can hahdle the upsets due to water expansion much better han a fractionation tower. In addition, beoause little product distillation is taking place in the blowdown drum, upsets due to water flashing are of much less concern wrth respect to downstream contamination.

However, further reduction in the incidence of water expansion upsets can be obtained by feeding the recovered oil containing water to the blowdown drum through the bottoms reboiler. By controlling the back pressure on the reboiler, water expansion can be controlled to mostly take place in the transfer piping thereby minimizing any damage to equipment. Vaporization in the reboiler is suppressed. The recovered oil stream, after having been combined with the bottoms reboiler recirculation stream and heated in the reboiler, flashes across a control valve 34 where the water is vaporized. Flashing or vaporization of the water occurs across the control valve because of the pressure drop across the valve and corresponding decrease in the bubble point temperature at which the water will vaporize. The resultant steam and hydrocarbon is then fed into the bottom of the blowdown drum. In this mode of operation, reboiler 26 is provided with sufficient process steam to heat both the reboiler recirculation stream and the recovered oil stream to a temperature above the dewpoint of the water.

To limit hydrocarbon carryover out the top of the blowdown drum, the temperature in the top of the blowdown drum is controlled by circulating blowdown drum bottoms through a cooler 36 and back to the top of the blowdown drum as reflux. Preferably, cooler 36 is an air cooler that draws air 38 over conduit carrying blowdown bottoms through the cooler. A bypass line 40 around cooler 36 is provided in reflux loop 22 so that recirculated bottoms can either be cooled by the air cooler, completely bypass the air cooler or be a combination of cooled and bypassed bottoms. A split range temperature controller connected to a valve 41 in line 40 and a valve 42 in the line through the air cooler sets the split around the air cooler to maintain a constant overhead temperature for the blowdown drum. Preferably, an overhead temperature of about 275° F. is maintained.

Steam and light hydrocarbon is carried upt the blowdown drum where it is refluxed. An overhead stream leaves the top of the blowdown drum through a line 44. This overhead stream consists mainly of water and some light hydrocarbon. The overhead stream rs condensed and The oil recovered in the first stage is either returned to the bottom of the blowdown drum or to the recovered oil storage tank. Returning oil to the blowdown drum improves second stage is sent to the recovered oil storage tank. The water recovered in the condensing system is sent to a sour water storage tank (not shown).

The hydrocarbon liquid fed to the blowdown drum falls out the bottom of the blowdown drum and is fed rough line 24 to the coker fractionator. Although the composition of this dewatered, recovered oil feed enters the vary, it will usually be fed to the coker fractionator at a point above that where the residual oil feed enters the coker fractionator. The residual oil feed is normally fed to the coker fractionator at the very bottom of the column below the trays through a line 46. Multiple feed points for the blowdown drum bottoms to the fractionator are normally provided to accommodate variances in the composition of the recovered oil.

The coker feedstock stream leaves the bottom of the coker fractionator through a line 48 and is fed through a coker heater (not shown) and then to the coke drums (not shown). A light hydrocarbon product stream leaves the top of the coker fractionator through a line 50. One or more intermediate product streams may also be taken off the coker fractionator by intermediate product lines such as line 52. Thus, the recovered oil stream dewatered in the blowdown drum is reprocessed into useful hydrocarbon streams.

The foregoing description of a preferred embodiment of the present invention illustrates the invention but is not intended to limit the scope of the invention. Rather, the invention is to be given a full and fair scope in accordance with the following claims.

What is claimed:

1. In a refinery that contains a delayed coker unit, a process for dewatering and recovering valuable products form a refinery recovered oil stream containing water generated from sources outside the delayed coker unit, comprising the steps of:

introducing the recovered oil stream into a blowdown drum also used for receiving overhead vapor and liquids from a coke drum of the delayed coke unit while it is off line in a coking cycle and having an internal bottom portion;

maintaining the temperature of the bottom portion of the blowdown drum at a temperature above the dewpoint temperature of the water in the blowdown drum so that water is vaporized;

removing the vaporized water from the blowdown drum; and feeding a stream exiting the bottom portion of the blowdown drum to a fractionator, which is also used for fractionating feedstock to the delayed coker unit, for separation into product streams.

2. The process of claim 1 also comprising the step of heating the recovered oil stream to a temeprature above the dewpoint temperature of the water in the recovered oil stream before introducing the recovered oil stream into the blowdown drum.

3. The process of claim 2 wherein the recovered oil stream is heated indirectly in a reboiler for the blowdown drum.

4. The process of claim 1 wherein the blowdown drum has internal trays and the recovered oil stream is introduced into the blowdown drum below the trays.

5. The process of claim 1 wherein the blowdown drum has an internal top portion from which a stream containing the water removed from the recovered oil can exit the blowdown drum and also comprising the step of maintaining the temperature of the stream exiting the top portion of the blowdown drum at a temperature of about 275° F.

6. The process of claim 1 wherein the blowdown drum has an internal top portion from which a stream containing the water removed from the recovered oil can exit the blowdown drum and also comprising the steps of:

diverting part of the stream from the bottom portion of the blowdown drum into a separate stream;

cooling the separate stream; and refluxing the cooled separate stream to the top portion of the blowdown drum to minimize the amount of recovered oil carried over in the stream exiting the top portion of the blowdown drum.

7. The process of claim 1 wherein the blowdown drum has an internal top portion from which a stream contain the water removed from the recovered oil can exit the blowdown drum and also comprising the steps of:

condensing a stream containing the removed water exiting the top portion of the blowdown drum;

separating recovered oil carried over from the blowdown drum from the remainder of the condensed stream; and recirculating the separated recovered oil back to the blowdown drum.

8. A process for dewatering and recovering valuable products from a refingery recovered oil stream containing water, comprising the steps of:

heating the recovered oil stream to at emperature above the dewpoint temperature of the water in the recovered oil stream before introducing the recovered oil stream into a blowdown drum;

flashing the heated recovered oil stream across a control valve to vaporize at least some of the water in the recovered oil stream before the recovered oil stream is introduced into a blowdown drum;

introducing the recovered oil stream into a blowdown drum having an internal bottom portion;

maintaining the temperature of the bottom portion of the blowdown drum at a temperature above the dewpoint temperature of the water in the drum; and feeding a stream exiting the bottom portion of the blowdown drum to a fractionator for separation into product streams.

9. A process for dewatering and recovering valuable products from a refinery recovered oil stream containing water, comprising the steps of:

heating the recovered oil stream to a temperature above the dewpoint temperature of the water in the recovered oil stream before introducing the recovered oil stream into a blowdown drum, the heating of the recovered oil stream occurring indirectly in a reboiler for the blowdown drum;

providing a control valve downstream of the reboiler adapted to maintain a back pressure on the reboiler sufficient to substantially suppress vaporization of the water in the recovered oil stream at the reboiler and to vaporize at least some of the water in the recovered oil stream before the recovered oil stream is introduced into a blowdown drum;

introducing the recovered oil stream into a blowdown drum having an internal bottom portion;

maintaining the temperature of the bottom portion of the blowdown drum at a temperature above the dewpoint temperature of the water in the drum; and feeding a stream exiting the bottom portion of the blowdown drum to a fractionator for separation into product streams.

10. In a refinery that contains a delayed coker unit, apparatus adapted for dewatering and recovering valuable products from a refinery recovered oil stream containing water generated from sources outside the delayed coker unit, comprising:

a blowdown drum adapted to also be used for receiving overhead vapor and liquids from a coke drum of the delayed coke unit while it is off line in a coking cycle and having an internal bottom portion;

means for conducting the recovered oil stream into the blowdown drum;

means for maintaining the temperature of the bottom portion of the blowdown drum at a temperature above the dewpoint temperature of the water in the blowdown drum so that water is vaporized;

means for removing the vaporized water from the blowdown drum;

a fractionator coupled to means for feeding fractionated feedstock to the delayed coker unit; and means for conducting a stream exiting the bottom portion of the blowdown drum to the fractionator for separation into product streams.

11. The apparatus of claim 10 also comprising means for heating the recovered oil stream to a temperature above the dewpoint temperature of the water in the recovered oil stream in the means for conducting the recovered oil stream into the blowdown drum.

12. The apparatus of claim 11 wherein the means for heating is a reboiler adapted for heating by indirect heat exchange.

13. The apparatus of claim 10 wherein the blowdown drum has internal trays and the means for conducting the recovered oil stream into the blowdown drum enters the blowdown drum below the trays.

14. The apparatus of claim 10 wherein the blowdown drum has an internal top portion and also comprising means for conducting a stream containing the water removed from the recovered oil from the top portion of the blowdown drum and means for maintaining the temperature of the stream exiting the top portion of the blowdown drum at a temperature of about 275° F.

15. The apparatus of claim 10 wherein the blowdown drum has an internal top portion and also comprising:

means for conducting a stream containing the water removed form the recovered oil from thet op portion of the blowdown drum;

means for diverting part of the stream from the bottom portion of the blowdown drum into a separate stream;

means for cooling the separate stream; and means for refluxing the cooled separate stream to the top portion of the blowdown drum to minimize the amount of recovered oil carried over in the stream exiting the top portion of the blowdown drum.

16. The apparatus of claim 10 wherein the blowdown drum has an internal top portion and also comprising:

means for conducting a stream containing the water removed from the recovered oil from the top portion of the blowdown drum;

means for condensing the stream exiting the top portion of the blowdown drum;

means for separating recovered oil carried over from the blowdown drum from the remainder of the condensed stream; and means for recirculating the separated recovered oil back to the blowdown drum.

17. Apparatus adapted for dewatering and recovering valuable products from a refingery recovered oil stream containing water, comprising:

a blowdown drum having an internal bottom portion;

means for conducting the recovered oil stream into the blowdown drum;

means for heating the recovered oil stream to a temperature above the dewpoint temperature of the water in the recovered oil stream in the means for conducting the recovered oil stream into the blowdown drum;

a control valve, adapted to vaporize at least some of the water in the recovered oil stream, in the means for conducting the recovered oil stream into the blowdown drum downstream of the means for heating in that means for conducting;

means for maintaining the temperature of the bottom portion of the blowdown drum at a temperature above the dewpoint temperature of the water in the drum;

a fractionator; and means for conducting a stream exiting the bototm portion of the blowdown drum to the fractionator for separation into product streams.

18. Apparatus adapted for dewatering and recovering valuable products from a refinery recovered oil stream containing water comprising:

a blowdown drum having an internal bottom portion;

means for conducting the recovered oil stream into the blowdown drum;

means for heating the recovered oil stream to a temperature above the dewpoint temperature of the water in the recovered oil stream in the means for conducting the recovered oil stream into the blowdown drum, wherein the means for heating is a reboiler adapted for heating by indirect heat exchange;

a control valve, downstream of the reboiler in the means for conducting the recovered oil stream into the blowdown drum, adapted to maintain a back pressure on the reboiler sufficient to substantially suppress vaporization of the water in the recovered oil stream at the reboiler and to vaporize at least some of the water in the recovered oil stream before the recovered oil stream is introduced into the blowdown drum;

means for maintaining the temperature of the bottom portion of the blowdown drum at a temperature above the dewpoint temperature of the water in the drum;

a fractionator; and means for conducting a stream exiting the bottom portion of the blowdown drum to the fractionator for separation into product streams.

* * * * *

UNITED STATES PATENT AND TRADEMARK OFFICE

CERTIFICATE OF CORRECTION

PATENT NO. : 5,223,152

DATED : June 29, 1993

INVENTOR(S) : Douglas A. Freymeyer, J. Paul Love, Richard L. Holloway, Daniel L. Torres, Alfred G. Brosman It is certified that error appears in the above-identified patent and that said Letters Patent is hereby corrected as shown below:

Column 7, line 31, "form" should read - - - from - - -.

Column 7, line 50, "temeprature" should read - - - temperature - - -.

Column 8, line 13, "contain" should read - - - containing - - -.

Column 8, line 24, "refingery" should read - - - refinery - - -.

Column 8, line 27, "at emperature" should read - - - a temperature - - -.

Column 9, line 46, "form" should read - - - from - - -.

Column 9, line 46, "thet op" should read - - - the top - - -.

Column 10, line 9, "refingery " should read - - - refinery - - -.

Column 10, line 29, "bototm" should read - - - bottom - - -.

Signed and Sealed this

Third Day of May, 1994

Bruce Lehman

*Attest:*

BRUCE LEHMAN

*Attesting Officer*

*Commissioner of Patents and Trademarks*